US005141129A

United States Patent [19]

Jennings

[11] Patent Number: 5,141,129

[45] Date of Patent: Aug. 25, 1992

[54] ARTICLE DISPENSER WITH SELECTIVE CHILD-RESISTANCE CONFIGURATION

[76] Inventor: Paul D. Jennings, 1039 E. Almond Ave., Orange, Calif. 92666

[21] Appl. No.: 672,513

[22] Filed: Mar. 19, 1991

[51] Int. Cl.[5] ..... B65D 83/00

[52] U.S. Cl. ..... 221/154; 221/306; 222/153; 222/519; 222/522; 206/536; 206/807

[58] Field of Search ..... 221/303, 306, 152, 154, 221/268; 206/536, 807; 215/206, 222, 224, 225, DIG. 3; 222/153, 519, 522, 524, 549, 553

[56] References Cited

U.S. PATENT DOCUMENTS

| | | | |
|---|---|---|---|
| 2,353,629 | 7/1944 | Apfelbaum | 206/536 |
| 4,119,232 | 10/1978 | Thornton | 215/222 |
| 4,434,903 | 3/1984 | Cooke | 215/222 |
| 4,784,288 | 11/1988 | Jennings | 206/536 |
| 4,893,728 | 1/1990 | Jennings et al. | 221/306 |
| 4,971,203 | 11/1990 | Weinstein | 206/536 |

*Primary Examiner*—H. Grant Skaggs
*Attorney, Agent, or Firm*—Leonard Tachner

[57] ABSTRACT

An article dispenser having a container or container mating portion and a dispenser control member, the former being in coaxial contiguous engagement with the latter for relative slideable motion therebetween. In the preferred embodiment of the invention disclosed herein, the slideable motion is in a vertical direction substantially parallel to the access of the container. A flexible member is provided which may be made integral to either the container portion or the dispenser control member and provides positive locking control for opening and closing the dispenser and provides means for making a substantially permanent engagement between the container portion and the dispenser control member. In addition, the dispenser control member provides a plurality of channels one of which includes a bead or rise and the upper ring portion of the container member provides an undercut or wedge-shaped tab which is designed to reside in these channels. The particular channel in which it resides at any one time determines whether the invention is being used in a child-resistant or a non-child-resistant mode. Transfer of the wedge-shaped bead in these channels is accomplished by simply rotating the dispenser control member relative to the container portion to place that bead either in a channel having no rise or bead for restraining the movement of the dispenser control member for opening and closing the article dispenser or in a channel having such a bead for introducing such constraint. The degree of constraint is determined by the thickness of the bead in a channel within the dispenser control member to render the article dispenser child-resistant in this mode.

4 Claims, 4 Drawing Sheets

ARTICLE DISPENSER WITH SELECTIVE CHILD-RESISTANCE CONFIGURATION

BACKGROUND OF THE INVENTION

1. Field of the Invention

This invention relates to the art of containers and particularly to the art of capless containers for use in dispensing medicine.

2. Prior Art

Containers which have caps for allowing an opening to be covered or uncovered are known in the art. These containers come in a variety of shapes and sizes and are used for a variety of materials. A bottle portion typically serves to contain the material being stored and also provides an opening such as a threaded neck for attaching a cap. Many of these containers are designed to be child-proof by providing caps which must be manipulated in a particular fashion in order to be removed. While many of these containers may be successful in preventing children from gaining access to the contents, they also prevent adults who may be arthritic or paralyzed or who, for some other reason, have the use of only one hand, from opening the containers. Thus these types of containers have limited usefulness since they cannot be used by adults unable to open them. One solution to this problem is disclosed in U.S. Pat. No. 4,893,728 issued Jan. 16, 1990 to the inventor hereof as a co-inventor. This patent discloses an easy-to-open article dispenser preferably made of molded plastic and comprising a container member having a chamber for containing a plurality of articles such as vitamin pills and a dispenser portion. The article dispenser also comprises a dispenser control member adapted for slideable engagement with the dispenser portion whereby to selectively place a first dispenser aperture in communication With a port or second aperture for opening the dispenser. Various alternative embodiments are disclosed in that patent including some embodiments which provide for axial motion for opening the container and some of which provide for rotational motion of the dispenser control member relative to the dispenser portion of the container member for opening the dispenser. While the invention disclosed in U.S. Pat. No. 4,893,728 can be manufactured as an easy open container which is not child-proof but which is easy for adults to open, it can also be manufactured as a child-proof container simply by increasing the frictional engagement between the dispenser control member and the dispenser portion of the container member so that a force higher than a predetermined child-proof threshold force is needed to open the container. Thus the aforementioned invention is highly flexible in the sense that it can be provided in either a child-proof or non-child-proof mode. Unfortunately, once that feature of the invention is specified, that is, it is either specified as child-resistant or non-child-resistant, it remains as such and cannot be varied in the field. Accordingly, manufacturers and retailers must supply article dispensers in both configurations in order to give the purchaser the option of choosing whether he or she wishes to purchase a child-resistant article dispenser for medicines or a non-child-resistant article dispenser for his medicines. It would therefore be extremely convenient and cost saving to the manufacturer and the purchaser, as well a means for saving shelf space for the retailer, to be able to provide an article dispenser of the type disclosed in the aforementioned prior art patent but which permits the purchaser to make that choice at any time even after he has purchased the article dispenser and taken it home.

SUMMARY OF THE INVENTION

The present invention comprises an article dispenser having a container or container-mating portion and a dispenser control member, the former being in coaxial contiguous engagement with the latter for relative slideable motion therebetween. A flexible member, which may be made integral to either the container portion or dispenser control member in alternate embodiments, provides positive locking control for opening and closing the dispenser and provides means making a substantially permanent engagement between the container portion and the dispenser control member. This feature of the present invention is substantially identical to that disclosed in the aforementioned U.S. Pat. No. 4,893,728. However, unlike the invention disclosed in the aforementioned patent, the present invention provides an additional feature which allows the user to determine by simply twisting the dispenser control member relative to the container member, whether he or she wishes to operate the article dispenser of the invention in a child-resistant mode or alternatively, in a non-child-resistant mode.

The present invention has particularly advantageous application in the pharmaceutical industry for containing and dispensing pills such as vitamin pills, prescription drug pills or other products which can be conveniently packaged in pill form. It will be seen hereinafter that one of the principal advantages of the present invention resides in its convenience of use for the purpose of dispensing such pills while in one mode requiring the application of a nominal pressure for activation by the user to release a pill and in a second mode selected by the user requiring the application of a significant pressure for activation by the user to release a pill. Other advantages of the present invention relate to its simplicity and economy of structure. More specifically, the invention comprises only two separate units which are readily and easily integrated in an assembly process. Furthermore each of these units is preferably made of a readily moldable plastic thereby enabling high volume and low cost production minimizing the retail cost of the invention and rendering it readily available to the general public.

In its non-child-resistant mode the dispenser of the present invention is particularly important to those who, for reasons of handicap or other reasons, would find it especially useful to be able to dispense a pill in such a simple and convenient manner without requiring the use of two hands. Of course, the latter advantage is not necessarily limited to handicapped individuals such as arthritic patients and the like who would find the dispenser of the present invention particularly advantageous for their particular limitations. The ease of dispensing articles by means of the present invention in its non-child-resistant mode which may be readily accomplished by the use of one hand, is also particularly beneficial to individuals who would otherwise ordinarily have the use of both hands, but are in situations where it is not convenient to employ both hands. By way of example, an individual driving a vehicle who wishes to dispense a pill by means of the present invention, a pill which he or she must take at a particular time even during driving, would find it particularly advantageous to use the present invention in its non-child-resistant mode whereby it is not necessary to remove both hands from the steering wheel of the vehicle.

A particularly unique feature of the present invention is the provision of selection of either a child-resistant mode or non-child-resistant mode by simply twisting the dispenser control member relative to the container member while the container is in its open configuration. Once the selection is made to choose the child-resistant mode, opening of the container then requires a significant force which can be selected to be above the child-resistant threshold level of force set by the pharmaceutical industry, whereby it then becomes necessary to use both hands and exert a considerable degree of force not within the capability of children below a certain age. The selection between the child-resistant mode and the non-child-resistant mode can be made at any time in either direction by the user in a simple and expedient manner which however requires the dispenser to be in its open configuration. Thus a child below the threshold age cannot place the dispenser in its non-child-resistant mode without first opening the container in its child-resistant mode Thus the present invention's conversion or selection feature is also child-resistant when the dispenser is in its child-resistant mode.

The child-resistant/non-child-resistant selection mode feature of the present invention is particularly advantageous because it permits the user to purchase one container or article dispenser which he can then configure in either a child-resistant or non-child-resistant mode depending upon whether there are children who might have access to the dispenser. Consequently, the manufacturer and retail store need only supply one such dispenser which can serve the needs of families with children as well as those without. Furthermore, there may be occasions when children are visiting such as when they visit elderly grandparents when it is desireable to put all medical article dispensers in a child-resistant mode only temporarily during the presence of children, but provide a means for reconfiguring the article dispensers for their non-child-resistant mode of operation when the children have left. It is believed that the present invention provides the only article dispenser specially adapted for dispensing pills where such a selectivity feature is provided.

OBJECTS OF THE INVENTION

It is therefore a principal object of the present invention to provide an article dispenser of the type which may be advantageously used for dispensing pills such as vitamins and pharmaceuticals and which dispenser provides two selective modes of operation, namely a child-resistant mode and a non-child-resistant mode.

It is an additional object of the present invention to provide an article dispenser of the type particularly adapted for dispensing pill-shaped articles such as vitamins and pharmaceuticals and the like and which is designed to be manufactured at low cost, using plastic molding processes and which is especially simple and easy to operate to dispense pills or other solid articles in a non-child-resistant mode, but which also provides a child-resistant mode which may be readily selected for increasing the difficulty of operation to prevent access to the contents by children below a preselected age.

It is still an additional object of the present invention to provide a two-piece article dispenser having a container for housing a plurality of solid articles to be dispensed and a dispenser control member which may be made to move in slideable engagement with the container for selectively releasing articles within the container, the dispenser providing the capability for the user to select a child resistant mode of operation or a non-child-resistant mode of operation.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment of the invention, when taken in conjunction with the following drawing.

DETAILED DESCRIPTION OF A PREFERRED EMBODIMENT

Figure 2:
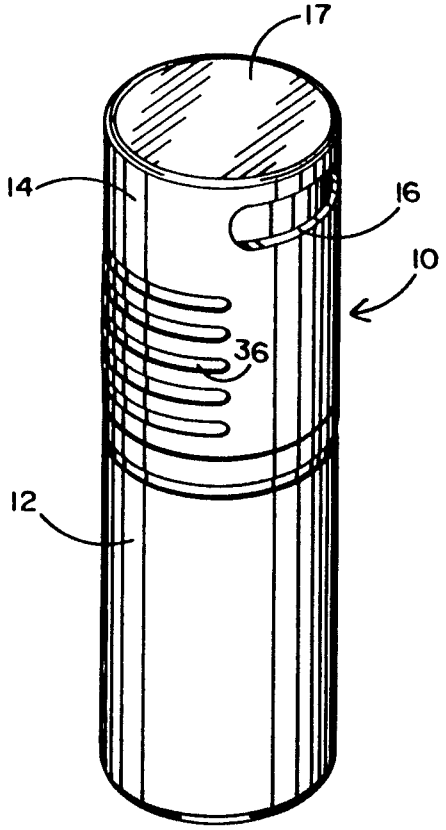
FIG. 2 is an isometric view of the invention shown in its closed configuration.
Figure 9:
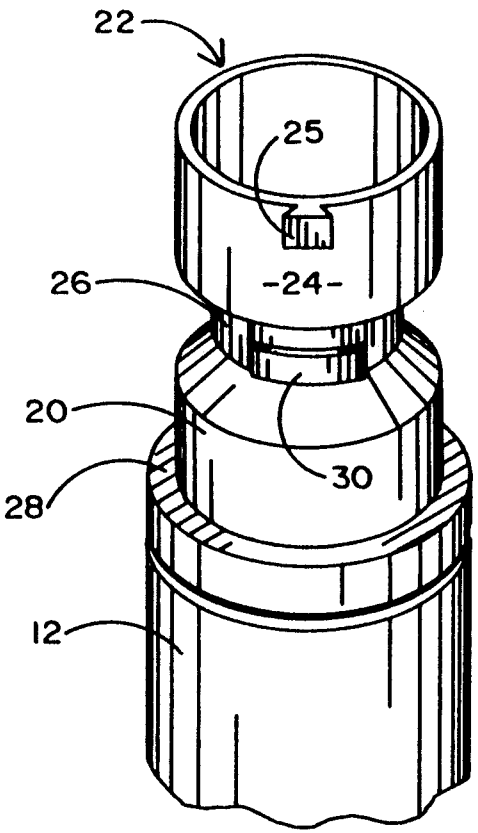
FIG. 9 is an isometric view of the container portion of the present invention.
Figure 8:
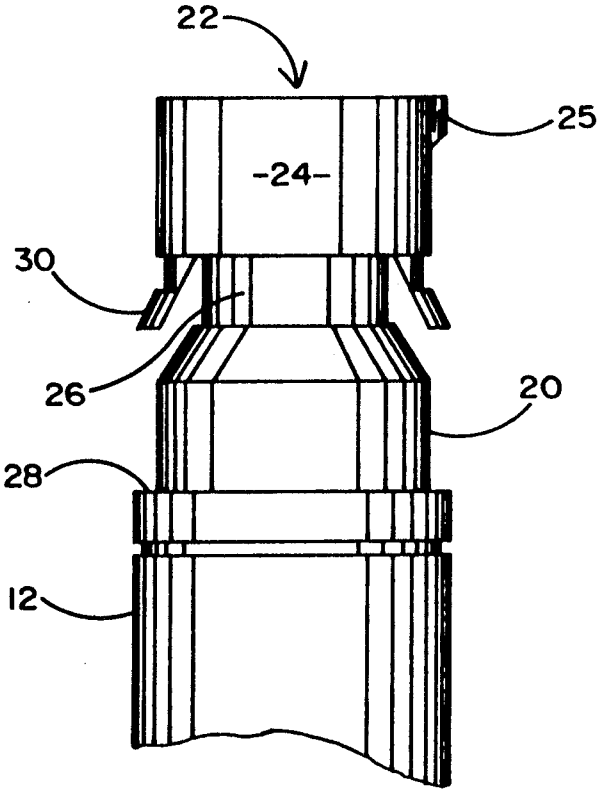
FIG. 8 is a side elevational view of the container portion of the present invention.

As seen in FIGS. 1–4 and 9, article dispenser 10 comprises a container portion 12 and a dispenser control member 14 as principal elements thereof. The dispenser control member 14 is characterized by a dispenser aperture 16 and a top surface 17. It will be seen hereinafter that the aperture 16 provides the exit through which articles contained within the container portion may be dispensed by the user. Container portion 12 comprises a chamber 18 adapted to house a plurality of selected articles such as pharmaceutical pills, vitamins and the like and is further characterized by having a dispenser portion 20 which as seen best in FIG. 9, comprises an access port 22, a ring 24, a neck 26 and an annular interface surface 28. In the particular embodiment illustrated in FIGS. 1–4 and 9, access port 22 provides access to chamber 18 as well as part of the exit path that an article contained within chamber 18 takes to reach the dispenser aperture 16 as will be hereinafter more fully understood. Ring 24 in effect provides a closure member depending upon the slideable relation between the container 12 and the dispenser control member 14. More specifically, when the container portion 12 and the dispenser control member 14 are placed into the open configuration illustrated in FIG. 1, the ring 24 is below the dispenser aperture 16 thereby providing a direct path between access port 22 and the aperture 16 to permit articles to be dispensed. However, when the container portion 12 and dispenser control member 14 are compressed toward one another as illustrated in the configuration of FIG. 2, then the ring 24 is immediately adjacent the aperture 16 thereby in effect closing the dispenser aperture 16 and preventing articles contained within chamber 18 from being dispensed. Neck 26 and annular interface 28 provide a suitable interconnection between ring 24 and chamber 18, but also provide a control surface between the container portion 12 and the dispenser control member 14 by means of flexible protrusions 30 which extend diagonally from the neck 26 adjacent the ring 24. As seen in FIGS. 8 and 9, the flexible protrusions 30 are spaced around the neck 26 in a substantially symmetrical manner and provide a degree of bending flexibility in response to the frictional engagement therewith of the corresponding interior surfaces of dispenser control member 14 as will be hereinafter more fully described.

The detailed exterior and interior surfaces of dispenser control member 14 may be understood best by referring to FIGS. 3–6 which illustrate the relationship between container portion 12 and dispenser control member 14 in both the open and closed positions. It will be seen that the dispenser control member 14 comprises an exterior surface which is characterized by a plurality of annular recesses 36 the principal purpose of which is to provide the user with a readily graspable surface in order to apply the necessary frictional forces to open and close the article dispenser of the present invention. The lower-most portion of dispenser control member 14 is characterized by an annular flange 38 the purpose of which is to provided an upper limit of travel for the dispenser control member relative to the container portion whereby to prevent the user from inadvertently removing the dispenser control member after it has been placed upon the container portion for the first time.

Figure 1:
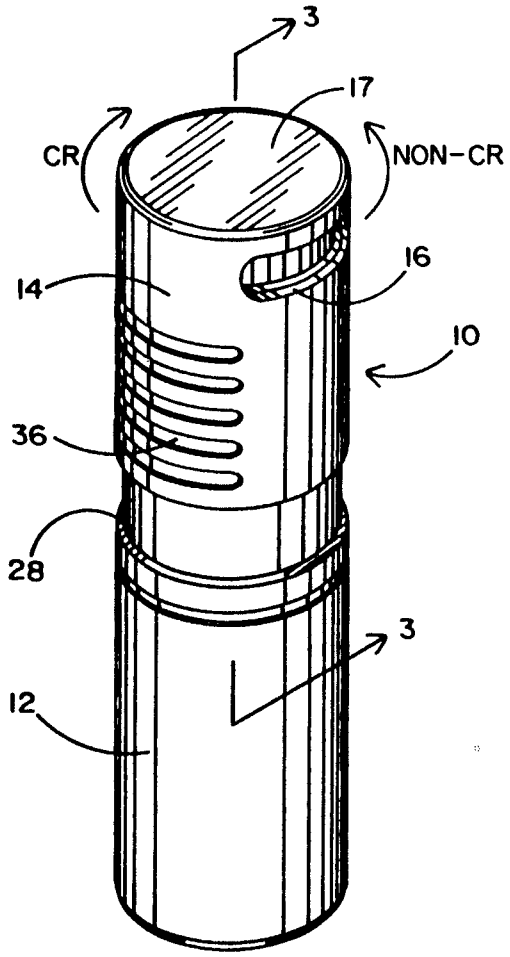
FIG. 1 is an isometric view of the invention shown in its open configuration.

The interior surface of dispenser control member 14 is characterized by a first rise 40, a second rise 42, a peak 44 and a third rise 46 which act in combination to provide the necessary frictional engagement with the flexible protrusions 30 of the container portion 12 whereby to provide positive positions of open and closed for the article dispenser of FIGS. 1 and 2. These surfaces give the user a sense of fixed position and provide a degree of frictional resistance to the movement therebetween which may be readily varied depending upon the annular relationship between the protrusions and the degree of extension of the peak 44 towards the ring 24.

Figure 4:
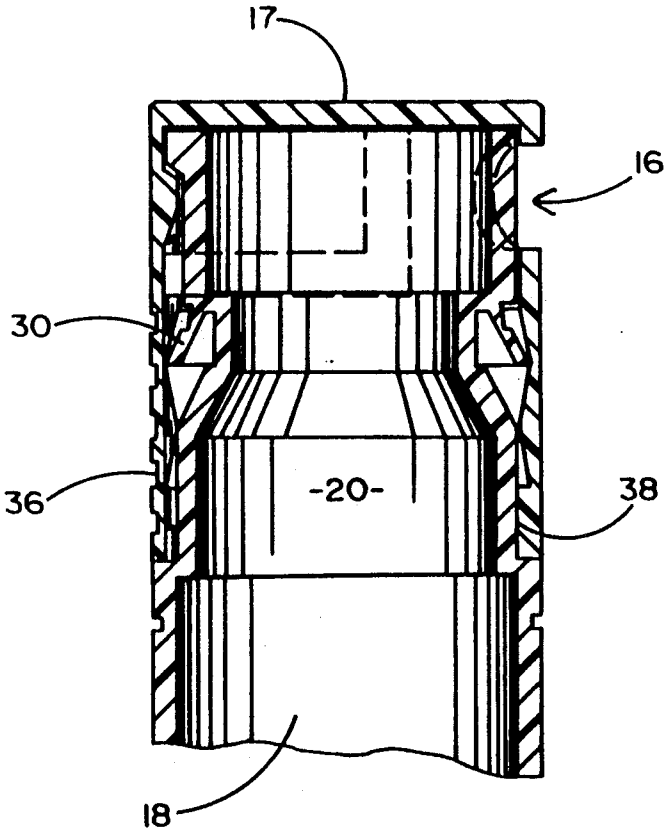
FIG. 4 is a cross-sectional view similar to that of FIG. 3, but corresponding to the closed configuration of FIG. 2.
Figure 3:
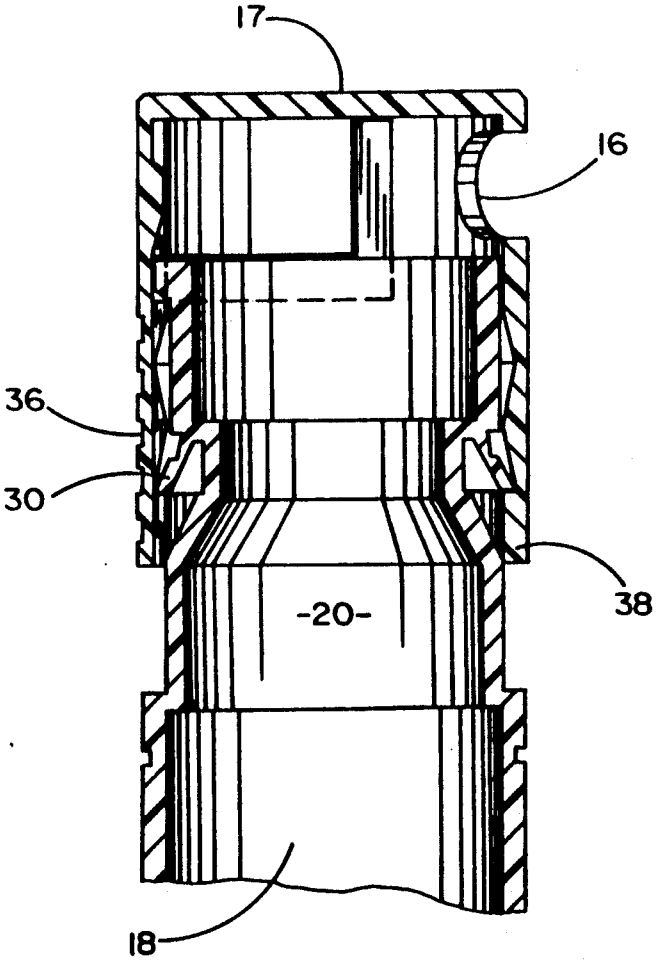
FIG. 3 is a cross-sectional view of the invention taken along lines 3—3 of FIG. 1.

As seen best in FIGS. 3 and 4, the article dispenser 10 is in its open position when the dispenser control member 14 is raised relative to the container portion 12. This configuration places the dispenser aperture 16 above the access port 22 whereby an article contained within chamber 18 may be readily directed toward the uppermost portion of chamber 18 through the dispenser portion 20 of the container portion 12 and out of access port 22 in dispenser aperture 16 to the exterior of the article dispenser 10. Similarly, the article dispenser 10 is in its closed position when the dispenser control member 14 is compressed or positioned downwardly toward the container portion 12 until the access port 22 is adjacent the top 17 of the dispenser control member 14. In this configuration, ring 24 is substantially blocking the dispenser aperture 16 and the top 17 is substantially blocking the access port 22 whereby it is not possible to release an article from the article dispenser 10. Furthermore it will be seen that in this closed configuration, the container portion 12 and the dispenser control member 14 provide a substantially closed path for protection of the interiorly stored articles from the outside environment of the article dispenser. Furthermore, this path may be further secured in a closed position by the placement of a seal over the aperture 16 in a conventional manner.

Figure 6:
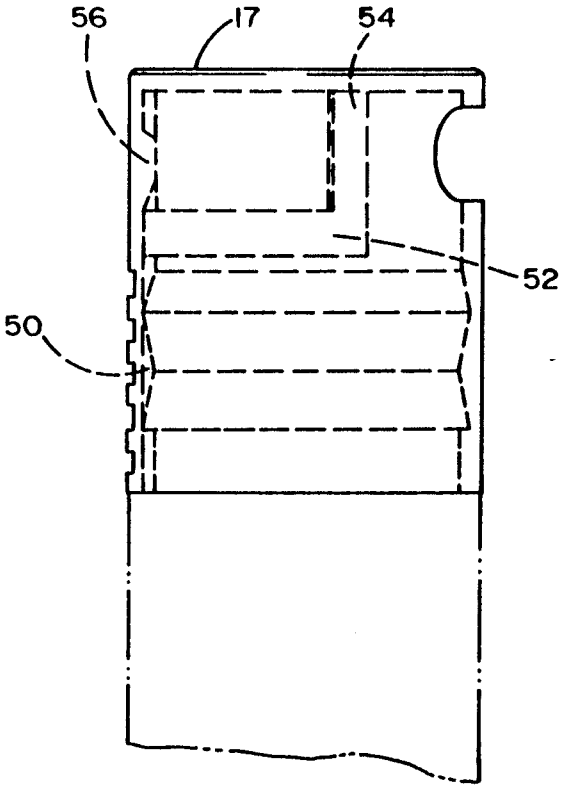
FIG. 6 is an elevational partially sectioned view of the combined dispenser control member and container portions of the present invention again showing the selectivity feature operation thereof.
Figure 7:
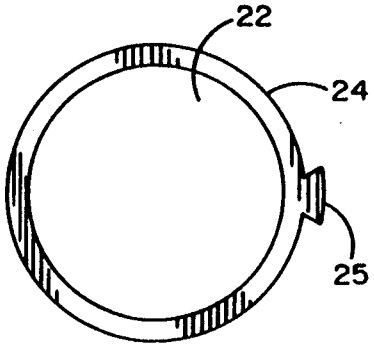
FIG. 7 is a top view of the container portion of the present invention.
Figure 5:
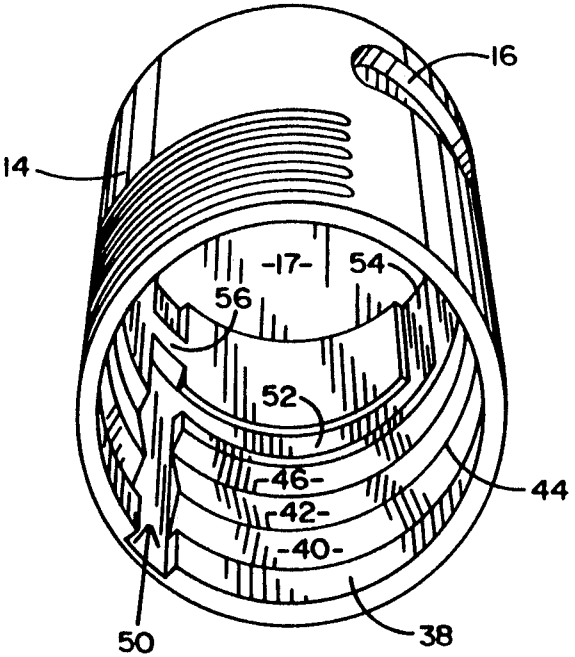
FIG. 5 is an isometric interior view of the dispenser control member of the present invention showing that portion thereof which permits the selectivity feature between child-resistant and non-child-resistant modes of operation.

The child-resistant selection feature of the present invention may be best understood by referring now to FIGS. 5–9. FIGS. 7–9 illustrate that the ring 24 around access port 22 of container portion 12 of the invention also provides an integral undercut or wedge-shaped tab member 25. FIGS. 5 and 6 illustrate the manner in which this tab member 25 is received within the dispenser control member 14 in order to provide both a child-resistant mode and a non-child-resistant mode which are selectable by the user. More specifically, referring now to FIGS. 5 and 6 it will be seen that the interior surface of member 14 is provided with a plurality of channels, namely, an elongated vertical channel 50 which runs the full length of the interior surface of member 14 from the lower rim to the top 17 thereof.

The majority of the length of channel 50, as well as all of a horizontal channel 52 and a small vertical channel 54 have a smooth flat surface. However, that portion of channel 50 which is close to the top 17 of member 14 is provided with a bead or rise 56. Once the dispenser control member 14 is installed onto the container portion 12 so that the flexible protrusions 30 act in conjunction with annular flange 38 to prevent the user from inadvertently removing the dispenser control member, tab 25 resides either within small vertical channel 54 or the upper-most portion of long vertical channel 50 adjacent bead 56. In order to place dispenser control member 14 onto container portion 12, it is necessary to align channel 50 with tab 25 while the installation takes place.

Because of the presence of bead or rise 56 within the uppermost portion of channel 50, a significant frictional engagement occurs between the exterior surface of tab 25 and the bead or rise 56 thus placing the invention initially in the child-resistant mode of operation. Each time the dispenser control member 14 is pulled its maximum distance from the container member 12 in order to open the container and gain access through aperture 16 to the articles contained therein, tab 25 is placed in channel 52. At this juncture continued vertical movement of the dispenser control member 14 between the open and closed positions will require the tab to slide over the rise or bead 56, the thickness of which determines the degree of child-resistance provided in the invention.

However alternatively, while the invention is in its open mode and tab 25 resides in channel 52, a counterclockwise rotation of the dispenser control member 14 with respect to the container portion 12 will cause the tab 25 to be slid along horizontal channel 52 until it is aligned with the short vertical channel 54. At this point, continued opening and closing of the article dispenser of the present invention will permit tab 25 to slide along short vertical channel 54 which has no rise or bead such as rise or bead 56. Accordingly, there is no significant additional friction incurred in opening and closing the article dispenser. Thereafter, at any time the user desires and while dispenser control member 14 is in its open configuration relative to container portion 12 and tab 25 again resides in horizontal channel 52, a clockwise rotation of the dispenser control member horizontally transfers the tab 25 along channel 52 until it reaches the upper portion of elongated vertical channel 50. At this point tab 25 must again slide over bead or rise 56 in order to open and close the container while tab 25 resides in channel 50.

Thus it can be seen that rotating the dispenser control member 14 so that tab 25 is either positioned within short vertical channel 54 or in the upper-most portion of elongated vertical channel 50, determines whether the present invention is in the child-resistant mode or in the non-child-resistant mode. If the invention is positioned so that it is in the child-resistant mode and closed whereby tab 25 is between rise 56 and the top 17 within elongated vertical channel 50, the dispenser control member 14 must first be pulled away from the container portion 12 opening the article dispenser before member 14 can be rotated to place the article dispenser in the non-child-resistant. Therefore, the present invention provides not only a child-resistant mode which makes it difficult for children under a selected age to open and close the article dispenser, the present invention also makes it equally difficult for the child-resistant mode to be changed over to the non-child-resistant mode because this must be done by first overcoming the child-resistance force that is determined by the thickness of bead or rise 56.

Thus it will be seen that the present invention provides all of the advantageous features of the applicant's prior invention disclosed in U.S. Pat. No. 4,893,728 but in addition, provides a novel new feature, namely, the ability to select either a child-resistant mode or a non-child-resistant mode depending upon the relative rotational position of the dispenser control member 14 relative to the container portion 12.

It will now be understood that the present invention comprises an article dispenser having a container or container mating portion and a dispenser control member, the former being in coaxial contiguous engagement with the latter for relative slideable motion therebetween. In the preferred embodiment of the invention disclosed herein, the slideable motion is in a vertical direction substantially parallel to the access of the container. A flexible member is provided which may be made integral to either the container portion or the dispenser control member and provides positive locking control for opening and closing the dispenser and provides means for making a substantially permanent engagement between the container portion and the dispenser control member. In addition, the dispenser control member provides a plurality of channels one of which includes a bead or rise and the upper ring portion of the container member provides an undercut or wedge-shaped tab which is designed to reside in these channels. The particular channel in which it resides at any one time determines whether invention is being used in a child-resistant or a non-child-resistant mode. Transfer of the wedge-shaped bead in these channels is accomplished by simply rotating the dispenser control member relative to the container portion to place that bead either in a channel having no rise or bead for restraining the movement of the dispenser control member for opening and closing the article dispenser or in a channel having such a bead for introducing such constraint. The degree of constraint is determined by the thickness of the bead in a channel within the dispenser control member to render the article dispenser child-resistant in this mode.

Those having skill in the art to which the present invention pertains will now, as a result of the applicant's teaching herein, perceive various modifications and additions which may be made to the invention such as alternative geometries, shapes and materials which may be utilized instead of those specifically described herein. However, it will be understood that the particular embodiment described herein is presented by way of exemplary illustration and that the invention contemplates all such modifications and additions and that the scope of the invention is to be limited only by the claims appended hereto and their equivalents.

I claim:

1. An article dispenser for containing a plurality of articles when in a closed condition and providing a path for dispensing the articles when in an opened condition upon selective actuation of the dispenser; the dispenser comprising:

a container member having a compartment for containing said articles, said container member having a dispenser portion including a first aperture through which said articles may pass;

a dispenser control member installed on said container member and relatively displaceable with respect to said container member, said dispenser having a second aperture for dispensing said articles when said second aperture is substantially aligned with said first aperture;

means for selecting either of at least two discrete degrees of difficultly in displacing said dispenser control member relative to said container member or substantially aligning said first and second apertures;

said selecting means being responsive to rotation of said dispenser control member relative to said container member for substituting one of said degrees of displacing difficulty for another one of said degrees of displacing difficulty; and said selecting means comprising means for enabling said rotation only when said article dispenser is in an opened condition.

2. The article dispenser recited in claim 1 wherein said selecting means comprises a plurality of channels on the interior surface of said dispenser control member and a protrusion on a mating surface of said container member, said protrusion residing in said channels, the friction between said protrusion and said channels being dependent on the selected degree of difficulty.

3. The article dispenser recited in claim 2 wherein at least one of said channels is oriented for directing said protrusion from a channel offering a first level of friction to said protrusion to a channel offering a second level of friction to said protrusion.

4. The article dispenser recited in claim 1 further comprising means for preventing complete separation of said dispenser control member from said container member after said dispenser control member is installed on said container member.

* * * * *